United States Patent [19]

Richards

[11] Patent Number: 4,607,574

[45] Date of Patent: Aug. 26, 1986

[54] CONVEYING SYSTEM FOR ROOFTOPS

[76] Inventor: Gerard B. Richards, 1618 Shreen Ct., San Jose, Calif. 95124

[21] Appl. No.: 751,295

[22] Filed: Jul. 2, 1985

[51] Int. Cl.[4] ..... E01B 23/00

[52] U.S. Cl. ..... 104/126; 104/107; 104/124; 104/125; 248/278

[58] Field of Search ..... 104/107, 124, 125, 126; 238/10 R; 182/45; 248/278, 283, 284

[56] References Cited

U.S. PATENT DOCUMENTS

| | | | |
|---|---|---|---|
| 670,207 | 3/1901 | Miller | 104/107 |
| 677,645 | 7/1901 | Elkins | 182/45 |
| 699,868 | 5/1902 | Harders | 104/126 |
| 1,366,944 | 2/1921 | Ritchie, Jr. | 104/124 |
| 1,509,381 | 9/1924 | Townsend | 403/57 |
| 2,446,093 | 7/1948 | Lambert | 182/45 |
| 3,000,329 | 9/1961 | Fargo et al. | 104/126 |

*Primary Examiner*—Robert B. Reeves
*Assistant Examiner*—Dennis Rodgers
*Attorney, Agent, or Firm*—Robert Samuel Smith

[57] ABSTRACT

A conveyor for carrying roofing debris to the edge of a roof which may be easily assembled on a roof with any pitch, moved from area to area as the work of tearing off old roofing material progresses and disassembled. A track, an assembly of track sections, is supported on a number of H frames which are braced and adjustable to accommodate any slant to the roof, by legs slidably adjustable in sleeved attachments to horizontal supporting bars. A winch, attached toward the loading end of the track, with cable attached to the winch and cart, controls descent of the cart down the track and may also be used to draw the cart back toward the loading end.

3 Claims, 5 Drawing Figures

FIG. 1
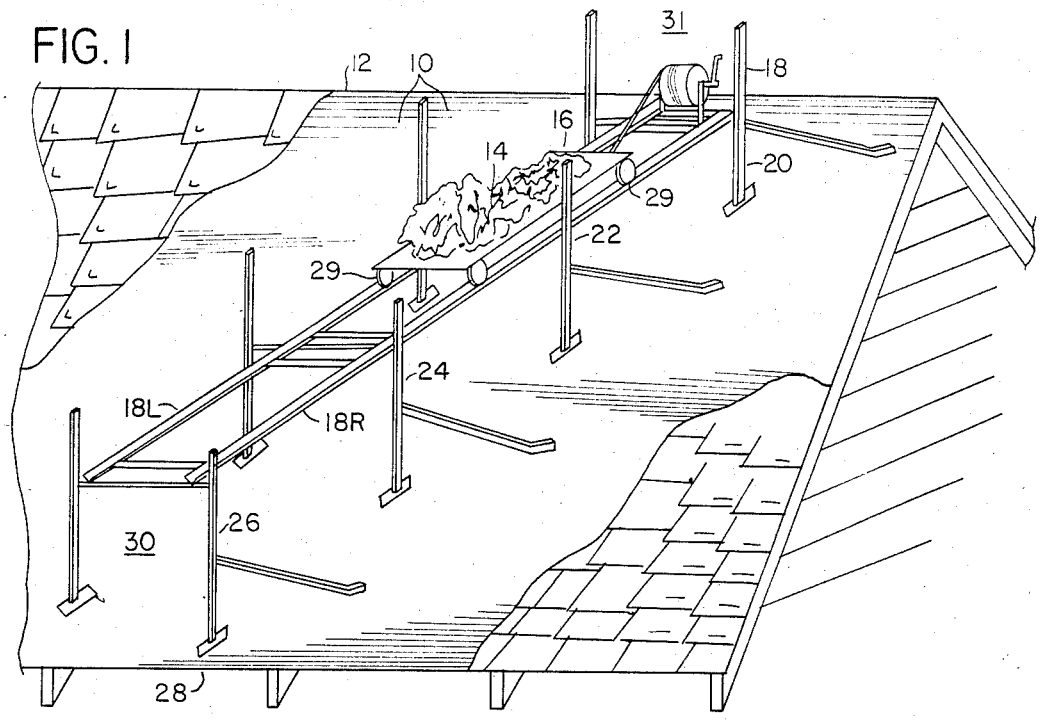
FIG. 2
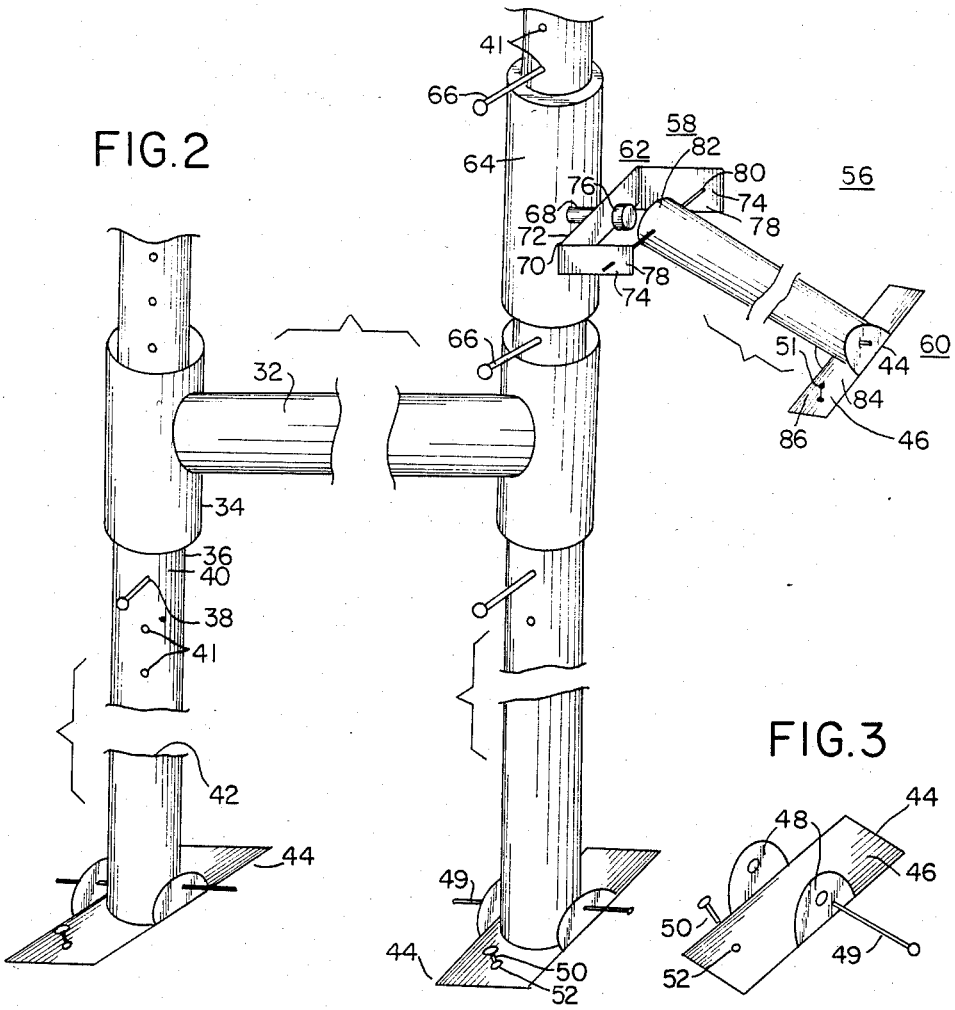
FIG. 3

CONVEYING SYSTEM FOR ROOFTOPS

BACKGROUND OF THE INVENTION

1. Field of the Invention

This invention relates to a conveying system for removing old roofing material from a roof preparatory to replacement with new roofing material.

2. Prior Art

Roofs of buildings are made with a variety of materials—tar paper, shingles, asphaltic tiles, etc. Because the roof surface is directly exposed to the weather, these coverings degrade so that after a period of time—generally twelve to twenty years, the roof covering must be replaced by new roofing material. The first step in replacing the roof is to tear off and remove the old weathered material ("tearoff"). Present practice is to tear off a portion of the old covering, carry it to the side of the building and drop it off onto the ground below. Use of conventional devices for carrying tearoff to the edge of the roof such as wheel barrows are not practical because of the pitch of the roof which renders the use of such devices awkward and dangerous. Furthermore, because material must be removed from large areas any, apparatus for conveying old material to the edge of the roof must be capable of being moved easily over a wide area, must be strong enough to support heavy loads, and must be constructed so that it can be adapted readily to various roof pitches.

There are many devices that have been built to convey a variety of materials. These devices include conveyor belts such as are used to convey goods and materials in factories and carts on tracks such as are used to haul ore from mines. However these conveying devices are built for use on flat surfaces, such as the floor of a factory (in the case of conveyor belts) or they have been built with permanent scaffolding and trestles (in cases such as cars on tracks used for hauling ore out of mines). Tracks of this type and associated supports have not been constructed so that they could be temporarily yet securely mounted at an arbitrary angle on a roof having a pitch occurring in a wide range.

SUMMARY OF THE INVENTION

It is an objective of this invention to provide means for conveying tearoff over large distances on sloping rooves so that it can be dumped over the side of the building.

It is a further objective that the means for conveying tearoff be easily assembled and dismantled—preferrably light enough for one man.

Still another objective is that the means for conveying may be adaptable to various slopes of the roof.

Yet another objective is that the conveying means can be assembled and operated on any desired angle with the edge of the roof and assembled over several sections of roof in which each section slopes differently or in a different direction from the other sections of the roof.

Briefly, the means for conveying is a cart which runs on a track. The cart is a flat rectangular platform with a wheel attached to the underside of the platform at each of the four corners. The wheels of the cart run in two troughs formed by metal angles held permanently parallel to one another by connecting bars. The entire track is an assembly of short sections of parallel angles (preferably metal) attached end to end. Alternatively, the track could be formed from channel however angles are preferred because an inexpensive method of joining sections is provided, angle is cheaper than channel and rubbing of the sides of the wheel with possible resultant binding as experienced with channel is avoided.

The track is supported on H frames spaced at appropriate distances from one another. Each H frame has a horizontal center bar to which the track is attached by U bolts which pass through the connecting bars so that the track may be positioned by rotation with respect to the center bar of the H-frame. At each end of the center bar a vertical leg is attached at a desired distance from a support end of the leg which rests on the roof. Each leg is a round bar (or pipe) which may be positioned by sliding within a short section of pipe which is secured at its center perpendicular to each end of the center bar. The distance from the support end of each leg to the center bar may be fixed by positioning the leg in the support sleeve and then inserting a pin into one of the holes lying in a row in the leg to fix the position of the leg relative to the center of the bar. Thus the supporting length of each leg of all the H frames is selected so that the track lies straight on the desired slant regardless of the pitch or variation of pitch of the roof and regardless of the angle which the track makes with the edge of the roof.

The supporting end of the each leg rests on a shoe. The shoe is a flat plate with ears on each side so that the shoe may be hinged to the leg by a pin passing through a hole near the support end of the leg and a hole in each ear of the shoe.

By positioning the shoe plate about its hinging pin and rotating the leg in its support sleeve, the shoe plate may be positioned to lie flat on the roof so as to provide a stable resting surface for the support end of each leg. A nail through a small securing hole in the plate and on into the roof prevents sliding of the shoe plate on the sloping surface.

On any of the legs, a brace may be positioned such that a support end of the brace with shoe plate hinged as described above is attached to the roof and the bracing end of the brace is attached to the leg by a universal joint. The universal joint is a bracing sleeve which slides for positioning on the leg and is then secured in position with a pin through the leg but not through the bracing sleeve. A short threaded stem is welded to the sleeve and perpendicular to the sleeve. A U-strap is bolted to the stem passing through a hole in the center of the U strap. A hinging pin, passing through a hole in each leg of the U-strap also passes through a hole through the bracing end. The brace is thereby provided with three axes of rotation—the first concentric with the bracing sleeve, the second perpendicular to the bracing sleeve and coincident with the hinging pin, the third coincident with the stem so that the shoe plate of the brace may be nailed flat to a convenient position on the roof regardless of pitch, proximity to the edge of the roof, etc. and maintain the H frame in its vertical position.

In order to control descent of the loaded cart and to draw the empty cart back to the upper end of the track, one end of a cable is fastened to an end of the cart and the other end is fastened to a winch positioned at the upper end of the track. The winch is a drum supported on its axle so that it can be turned by a crank rigidly attached to the axle of the drum.

The axle of the drum pases through aligned axle holes in the end segments of a yoke. The center segment of the yoke which is attached to the end segments has a short sled angle perpendicularly attached to each end of the center segment and a sled angle is positioned in the trough of each track angle. Therefore the winch may be located at any of the sites of the connecting bars and bolted to any of the connecting bars using holes in the middle segment.

A circular ratchet is also attached to the axle. A ratchet key is pivotally attached on the yoke so that it may be engaged or disengaged with the ratchet and used to lock the winch so that by turning the crank. An operator may place the cart at any position along the track and then secure the cart in position with the ratchet key.

A brake is also provided in order to prevent the cart from rolling independent of the winch such as when it is desired to move the winch to another location on the track. The brake is a short sleeve (pipe) with a longitudinal slot in its side aligned with a hole in the platform and attached perpendicular to the platform of the cart. A braking bar with a handle on one end and a stem on its side is oriented so that the bar may slide in the sleeve so that a second end of the braking bar extends through the hole and engages with a connecting bar thereby preventing the cart from rolling. The bar may be withdrawn and turned so that the stem holds the bar in the retracted position.

A bar across the track at the lower end prevents the cart from running off the end of the track.

Because of the sectional construction of the track and the light weight of all components including the sections of track and the cart, the tearoff conveyor may be easily transported to a jobsite, hoisted to roof top and assembled with appropriate allowance for the slope of the roof. When all of the tearoff has been removed from one area, the tearoff conveyor may be conveniently moved to other areas of the roof.

BRIEF DESCRIPTION OF THE DRAWINGS

FIG. 1 shows the tearoff conveyor mounted on a roof.

FIG. 2 shows details of the H frames and braces that support the track.

FIG. 3 shows details of the shoe attached to the supporting end of each leg of the H frame and each brace.

DETAILED DESCRIPTION OF THE INVENTION

Figure 4:
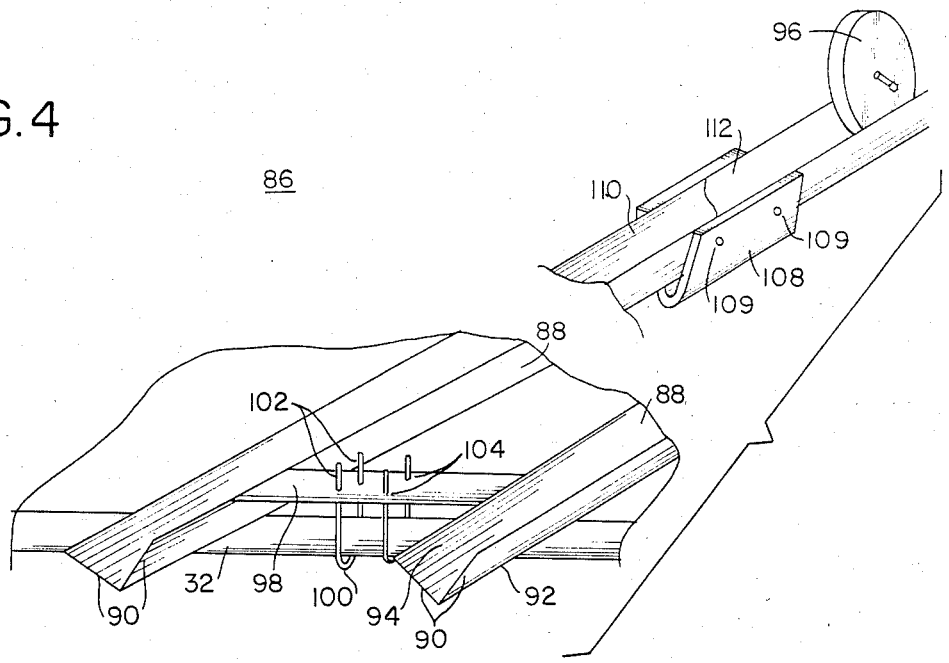
FIG. 4 shows details of a track section.

Turning now to a more detailed discussion of the figures, there is shown in FIG. 1 a tearoff conveyor 10 mounted on a roof 12 in accordance with the invention. There is shown tearoff 14 piled on a cart 16 which rides on a track 18. The track is supported on a number of H frames—20, 22, 24, 26. Because the track 18 is not set perpendicular to the edge 28 of the roof, the left side of the track 18L is closer to the roof than the right side 18R so that the axes of the front and rear wheels 29 are horizontal thereby avoiding the tipping of cart 16 off the track. In addition, the distance of the track 18 to the roof 12 is larger at the destination end 30 of the track in order to provide better control of the loaded cart 16 in its descent i.e., the track 18 is not sloped as steeply as the roof 12.

The positioning of the track 18 relative to the roof 12 is accomplished by adjustments on the H frames 20, 22, 24, and 26 as will be discussed with reference to FIG. 2 which shows components of the H frame and FIG. 3 which shows the foot 44 of the H frame and brace. Each H frame includes a horizontal center bar 32 with a supporting sleeve i.e. a short length of vertical pipe, 34 secured at each end. A leg 36 is positioned by sliding in each supporting sleeve 34 and secured by securing pin 38 inserted into positioning hole 40. Hole 40 is selected from the row of positioning holes 41 in legs 36 in accordance with the desired distance from the support ends 42 to the central bar 32 so that the center bar 32 is horizontal regardless of the slope of the roof. Support ends 42 rest on shoes 44. As shown in FIG. 3, each shoe 44 is a plate 46 with ears 48 so that each shoe 44 as shown in FIG. 3 is hinged about each support end 42 by a hinging pin 49. Consequently, by rotating the leg 36 in its supporting sleeve 34 and rotating each shoe 44 about its hinging pin 49, the shoe 44 may lie flat on the roof 12 regardless of the slant of the roof and secured with a nail 50 in a securing hole 52 in the plate 46.

In order that each H frame may be secure in the erect position, a brace 56 shown in FIG. 2 has a resting end 60 attached to the roof with another shoe 44 and a bracing end 58 attached to the leg 36. Attachment to the leg 36 is by means of a universal joint 62 which permits the shoe 44 to lie flat on the roof so that it may be fastened with a nail 51 thereby providing adequate support for the leg 36.

The universal joint 62 has a bracing sleeve 64 positioned by sliding on leg 36 and securing by a securing pin 66 in the appropriate positioning hole in row of holes 41. As shown in FIG. 2, the pin 41 does not pass through the bracing but under the bracing sleeve. A threaded stud 68 is secured to the bracing sleeve 64 perpendicular to the sleeve 64. A U strap 70 with a center leg 72 and two side legs 74 is bolted to the stud 68 which passes through a pivot hole 76. Aligned hinging holes 78 in the side legs provide hinged attachment to the bracing end 58 by a hinging pin 80 through the hinging holes 78 and a second hinging hole 82 near the bracing end 58. Thus when the leg 36 is positioned vertically on the roof 12, the U strap 70 is positioned by rotation and bolted on the threaded stud 68 and the bracing end 58 is positioned by rotation about the U strap 70 and the shoe 44 is positioned by rotation about the resting end 60 then the shoe 44 will lie flat on the roof so that it may be fastened to the roof by a nail 86 passing through a securing hole 84 in the shoe plate 46 regardless of the orientation of the slant of the roof.

Referring to FIG. 4, there is shown a section of track 86 which, with other sections laid end to end, makes up the entire length of track. Each section 86 has two track angles 88 formed by two strips 90 joined along a common edge 92 to form a trough 94 oriented to face the cart whose wheels 96 are confined to roll in the trough 94. The track lengths 88 are secured in their orientation and parallel relation to one another by connecting bars 98. each end of each connecting bar 98 is shown secured to one of the angles 88.

Still referring to FIG. 4, the means for securing the track section 86 to the center bars 32 are U bolts 100, each of which encloses a center bar 32 and having two threaded ends 102 which pass through fastening holes 104 in the connecting bar 98 and is secured by nuts.

The means for joining the track section to its neighbor is a short length of angle 108 positioned so that the end of a track angle 110 and the abutting end of the neighboring track angle 112 both lie in the trough of the short length of angle 108 and are secured by bolts.

Referring to FIG. 1, because the loading location 31 is higher than the destination location 30 gravity is used to pass the cart from the loading end 31 to the destination end 30 where the cart 16 is unloaded. Then it must be hauled back to the loading position 31. In order to control the descent of the cart and then to haul it back to the loading location, a braking and pulling means for the cart is provided wich will now be discussed with refrence to FIG. 5.

Figure 5:
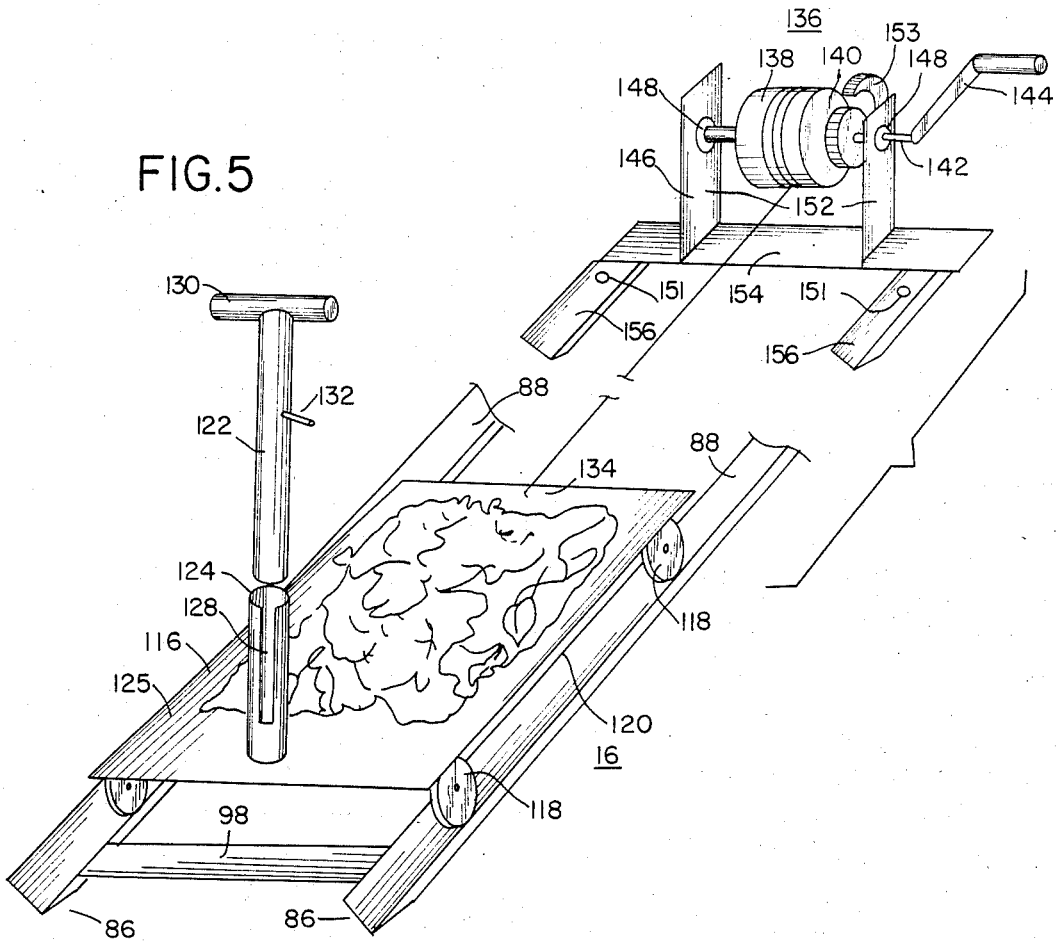
FIG. 5 shows details of the brake mounted on the cart and the winch for controlling motion of the cart.

As shown in FIG. 5, the cart 16 is a platform 116 with wheels 118 attached to the underside 120. A braking bar 122 slides in a braking sleeve 124 attached perpendicularly to the topside 125 of the cart so that the braking bar 122 may be pushed through the brake sleeve 124 and engage a connecting bar 98 of the track section 86 so as to prevent descent of the cart 16. The braking sleeve 124 has a slot 128 and the braking bar 122 with handle 130 has a key 132 which slides in the slot 128 so that when the braking bar is not in use, it may be partially withdrawn from the sleeve and fixed by turning the handle 130.

In order to control the speed of descent of the cart and to pull the cart toward the loading location, one end of a cable 134 is attached to the cart 16 shown cutaway while the other end of the cable is attached to a winch 136 located toward the loading end of the track. The winch 136 is a drum 138 and ratchet wheel 140 both mounted on an axle 142 to which is attached a winch handle 144 for turning the drum 138. The axle 142 is supported by a yoke 146 being a U shaped strap with aligned axle holes 148 in each of the two end segments 152 and a center segment 154. A short sled angle 156 is attached perpendicularly to each end of the center segment 154 so that it may be positioned in the trough of the track angle 88. The winch 136 is thereby positioned over the track and may be secured by winch bolts 15 through the center segment 154 and any of the connecting bars 98 depending on where it is desired to locate the winch 136.

A ratchet key 153 is attached to the yoke and pivots so that the drum 138 may be locked by engagement of the ratchet key 153 and ratchet wheel 140.

Thus the operator can locate the winch in the middle of the track which becomes his location for controlling the cart, then he may apply the brake and slide the winch to a higher location.

In actual practice, it has been found that the tearoff conveyor, operated in accordance with this invention saves two man days in stripping tearoff from a typical roof of 3200 square feet. Savings are considerably increased with larger rooves and a reduction of required man hours by 50% is typical.

I claim:

1. A conveyor for carrying a load that may be assembled on a sloping surfaces that comprises:

a cart having a platform with a top side for supporting said load and a plurality of wheels attached to said platform;

a straight continuous track on which said wheels may roll, which has a loading end and a destination end, and which further comprises a left track member spaced parallel to a right track member by a plurality of connecting bars, each end of each bar being rigidly secured to one of said track members and each bar having at least two boltholes;

a plurality of horizontal center bars, each having two bar ends and positioned under said left and right track members so as to support said track;

a plurality of U-bolts, each enveloping one of said center bars and secured in said boltholes of an adjacent connecting bar so that said track is rigidly secured to said center bars;

a vertical support sleeve secured on each said end of said center bars;

a vertical leg positioned by sliding within each support sleeve and having a row of positioning holes in its side into one of which a supporting pin may be inserted in order that an end of said support sleeve may rest on said pin and thereby determine the location of said support sleeve so as to maintain said center bar horizontal even though said conveying system is mounted on said sloping surface and wherein each said vertical leg has a hinging hole near its lower end;

a bracing sleeve positioned by sliding on each said leg and secured by a pin in said positioning hole at each end of said bracing sleeve so that said bracing sleeve can be oriented independent of said leg to any angular position about its axis by rotation about said leg;

a threaded stud attached to each said bracing sleeve and perpendicular to said bracing sleeve;

a U shaped strap having two ends such that each end has a hole concentric with said hole in said other end of said strap and, further, said U strap has a hole in its center through which said threaded stud is inserted so that said strap may be bolted to said bracing sleeve yet may be positioned by rotation about said stud;

a brace having a first end hinged to each U strap by a pin through a first hole near said first end and said hole in each end of said strap and wherein said brace has a second hole near a second end of said brace;

a shoe for each said brace and each said vertical leg comprising a plate with a securing hole and two ears, each having an earhole and each ear being attached to an edge of said plate so that said shoe may be attached to said second end of each brace and said lower end of each vertical leg by a pin through said earholes and said second hole of said brace and said hinging hole of said vertical leg;

so that each said leg, U shaped strap, shoe, brace and bracing sleeve may be positioned by rotation independent of one another in order that each said shoe will lie flat on said sloping surface regardless of the direction of slope and each said shoe may be secured to said sloping surface by a nail through each said securing hole.

2. A conveyor as in claim 1 wherein said cart further comprises:

said platform having an opening extending from said top side through said platform;

a brake sleeve which is a round tube secured at a first end of said brake sleeve to said top side of said platform concentric with said hole and wherein said brake sleeve has a slot extending parallel to the axis of said brake sleeve from a second end of said sleeve toward said first end;

a bar having a stem attached to its side and a handle attached to a first end of said bar;

so that by orienting said bar thereby aligning said stem with said slot, said bar slides in said brake sleeve and a second end of said bar extends through said brake sleeve and said aligned hole to engage one of said connecting bars thereby preventing the cart from rolling but when the bar is withdrawn and turned, said stem slides out of said slot and prevents said bar from returning to engage said connecting bar, permitting the cart to roll on said track.

3. A conveyor as in claim 2 which further comprises:

each of said left and right track members being an angle track wherein each said angle track is formed by two strips joined along a common edge to provide a trough with an opening oriented so that said wheels of said cart roll in said trough;

a yoke being a U shaped strap with a first segment, having a first axle hole connected by a middle segment to a second segment having a second axle hole aligned with said first axle hole;

a right and a left short angle, each rigidly attached to said middle segment and spaced so that said right short angle rests in said right track angle and said left short angle rests in said left track angle so that said yoke may be positioned by sliding said short angles in said track angles;

means for securing said short angles to said track angles;

a ratchet wheel and a drum having a common axle with two axle ends supported at each said axle end by passing through said axle holes;

a winch handle attached to one of said axle ends;

a ratchet key mounted on said yoke positioned so that it may be engaged or disengaged with said ratchet;

a cable having one end attached to said drum and another end attached to said cart;

so that by turning said handle a worker can control the speed of descent of said cart toward said loading end and secure said cart to a desired position by locking said drum by engaging said ratchet and said ratchet key.

* * * * *